US006314899B1

(12) United States Patent
Ballantyne

(10) Patent No.: US 6,314,899 B1
(45) Date of Patent: Nov. 13, 2001

(54) HOOK AND LOOP LOCK STITCH AND METHOD AND APPARATUS THEREFOR

(76) Inventor: David B. Ballantyne, 1252 S. Timberview Trail, Bloomfield Hills, MI (US) 48304

( * ) Notice: Subject to any disclaimer, the term of this patent is extended or adjusted under 35 U.S.C. 154(b) by 0 days.

(21) Appl. No.: 09/650,165

(22) Filed: Aug. 29, 2000

(51) Int. Cl.[7] ..... D05B 23/00
(52) U.S. Cl. ..... 112/475.17
(58) Field of Search ..... 112/475.17, 475.01, 112/475.14, 154, 104, 113, 470.33, 108, 228, 189, 181, 440, 402

(56) References Cited

U.S. PATENT DOCUMENTS

| | | | | |
|---|---|---|---|---|
| 43,236 | * | 6/1864 | Sturtevant | 112/475.01 |
| 174,764 | | 3/1876 | Blanchard . | |
| 1,093,239 | * | 4/1914 | Ballard | 112/189 |
| 1,114,533 | * | 10/1914 | Savignac et al. | 112/440 |
| 1,242,565 | * | 10/1917 | Lautenschlager | 112/475.17 X |
| 1,304,811 | * | 5/1919 | Schick, Jr. | 112/402 X |
| 1,619,497 | * | 3/1927 | Blake | 112/441 |
| 1,715,420 | * | 6/1929 | Mayer | 112/475.01 X |
| 3,301,206 | | 1/1967 | Lanzendorfer . | |
| 3,548,767 | | 12/1970 | Williams . | |
| 3,792,672 | | 2/1974 | Friedman et al. . | |
| 3,957,004 | | 5/1976 | Ketterer et al. . | |
| 4,067,273 | | 1/1978 | Marforio . | |
| 4,117,789 | | 10/1978 | Rovin et al. . | |
| 4,140,069 | | 2/1979 | Laursen . | |
| 4,366,765 | | 1/1983 | Hoekstra . | |
| 4,527,491 | | 7/1985 | Block et al. . | |
| 4,708,072 | | 11/1987 | Frye . | |
| 4,879,960 | | 11/1989 | Prais . | |
| 4,892,047 | | 1/1990 | Fieschi . | |
| 4,920,904 | | 5/1990 | Frye . | |
| 5,017,413 | | 5/1991 | Moschini . | |
| 5,337,688 | | 8/1994 | Arima . | |
| 5,566,633 | | 10/1996 | Wesstrom . | |
| 5,732,641 | | 3/1998 | Kawasaki . | |

* cited by examiner

*Primary Examiner*—Ismael Izaguirre
(74) *Attorney, Agent, or Firm*—Vanophem & Vanophem, P.C.

(57) ABSTRACT

An article, method, and related apparatus for a novel hook and loop lock stitch. The lock stitch is embodied in a stitched article that includes a workpiece including a series of stitch holes, or a seam, therethrough and further including a back side surface composed of a hook material including hooks therein. The lock stitch is provided through each stitch hole, and includes an upper thread extending down through each stitch hole, forming a loop underneath the workpiece, and extending back up through each stitch hole. A lower thread, or strip, is composed of a hook material including hooks therein. The loop is spread out amongst the hooks of the lower thread and interlocks therewith. The lower thread is thus entrapped between and within the loop and the back side surface of the workpiece. The workpiece can include the back side surface being composed of a loop material including loops therein for interlocking with the hooks of the lower thread. The stitched article can also include an underlining applied to the back side of the workpiece and over the lower thread. The underlining can be composed of a loop material including loops therein interlocking with the hooks of the hook material of the lower thread to retain the underlining to the workpiece.

37 Claims, 6 Drawing Sheets

HOOK AND LOOP LOCK STITCH AND METHOD AND APPARATUS THEREFOR

BACKGROUND OF THE INVENTION

1. Field of the Invention

The present invention generally relates to methods and apparatus of sewing and stitching. More specifically, this invention relates to a lock stitch, wherein a novel "hook and loop" style lower thread is interlocked with a conventional upper thread.

2. Description of the Prior Art

Until now, the two-thread lock stitch has been among the most widely used methods of joining fabric. Conventionally, and as shown in FIGS. 1 and 2, a two-thread lock stitch 32P includes two threads: a needle or upper thread 24, and a bobbin or lower thread 50P. The upper thread is typically wound on a spool system (not shown) to provide a continuous feed of thread. In contrast, the lower thread 50P is typically wound on a bobbin 54P to provide a predetermined feed of thread. The two-thread lock stitch 32P is considered an efficient stitch that does not unravel easily and has a "both-sides equal" aesthetic appearance. In order to maintain the aesthetic appearance, the upper and lower threads 24 and 50P must typically be composed of nearly identical size and strength material to enable stitch conformance.

Stitch conformance relates to the relative position of the upper and lower threads 24 and 50P in the stitch as shown in FIGS. 1 and 2. Conventional lock stitch practice requires a balance of stitching force on either side of a workpiece 10P being sewn, so that the lower thread 50P is not completely pulled up through the workpiece 10P. FIGS. 1 and 2 illustrate how the upper thread 24 and lower thread 50P must properly entwine at a midpoint 16P of the workpiece 10P.

Referring to FIG. 1, in operation, a needle 20 penetrates the workpiece 10P from a front side 12P thereof, carrying with it the upper thread 24 that is fed through an eyelet 22 of the needle 20. The needle 20 reaches the bottom of its stroke on a back side 14P of the workpiece 10P and starts to retract, thus forming a loop 26 from the slack upper thread 24. Referring now to FIGS. 1 and 2, and as is well known in the art, the bobbin 54P and the entire supply of lower thread 50P is encircled by the loop 26 in order to interlock the upper and lower threads 24 and 50P, thus forming the locking portion of the lock stitch 32P. The size of the bobbin 54P and quantity of lower thread 50P is necessarily relatively small to enable them to be encircled by the loop 26. Therefore, the bobbin 54P is exhausted of its lower thread 50P at extremely frequent intervals, resulting in downtime of the sewing operation, and, often, stopping and restarting of the sewing operation in the middle of the workpiece 10P.

Several alternative methods and associated devices of the prior art have been directed at mitigating the problem of the limited supply of lower thread. For example, U.S. Pat. No. 4,117,789 to Rovin et al. teaches a method of automatically loading a bobbin in situ. Rovin et al. disclose a highly complex apparatus that is capable of reloading an empty bobbin in between workpiece cycles and as an operator positions a new workpiece to the sewing machine. The apparatus refills the empty bobbin, in situ, with a precisely measured length of thread.

U.S. Pat. No. 4,140,069 to Laursen teaches a sewing method and associated apparatus for forming a double backstitch seam. The double backstitch seam is formed similarly to previous versions of two-thread lock stitches with one exception. The upper thread is fed through the workpiece and a loop thereof is formed as usual. The lower thread, however, is processed much differently than those of the prior art. The supply of lower thread is not passed entirely through the loop as usual, but instead is passed through the loop in individual thread sections equal in length to several stitches. The lower thread is fed from a relatively large continuous spool, similar to the upper thread. As the loop is formed, a free end of the lower thread is fed and sucked through the loop by a suction nozzle. As the loop is tightened by the needle retracting back through the workpiece, a looper simultaneously grabs the lower thread section near its middle and a free end of a previous lower thread section. The looper then pulls back and tightens the lower thread sections against the loop, thus completing a lock stitch.

Finally, U.S. Pat. No. 4,366,765 to Hoekstra teaches use of a combination single thread chain and lock stitch. Hoekstra discloses a stitch formation having a first loop passing through the workpiece thus forming the first half of a chain stitch. A second loop passes through the workpiece and, with the first loop, forms the second half of the chain stitch. A locking thread passes through the closed end of the second loop to form a lock stitch. The chain and lock stitches thus formed are continuously alternated for the entire length of the stitch.

In addition to the problem of a limited supply of lower thread, thread breakage is a frequent problem when generating the conventional lock stitch. If either the upper or lower thread breaks during a stitch cycle, the entire process must be stopped and the sewing machine re-threaded. Additionally, the article being sewn must be scrapped, or the stitch removed and restarted, since the stitch cannot be stopped and restarted in mid-stitch.

Therefore, what is needed is a lock stitch, method, and related apparatus that is inexpensive, efficient, does not require a bobbin having a limited supply of lower thread, that uses a method and apparatus that are relatively simple compared to the prior art, and that is not so susceptible or sensitive to thread breakage.

SUMMARY OF THE INVENTION

According to the present invention there is provided a novel lock stitch that does not require use of a bobbin nor other complex thread feeding mechanisms, thereby avoiding the shortcomings of the prior art—particularly that of thread breakage and a limited supply of lower thread.

In one form of the invention, an article is provided in the form of a workpiece having a novel lock stitch. Preferably, the stitched article includes the workpiece having upper and lower layers or plies, and a series of needle-made stitch holes extending from a front side through to a back side thereof. A stitch is provided through each stitch hole, and includes an upper thread and a lower thread. The upper thread extends down through each stitch hole, forms a loop underneath the workpiece, and extends back up through each stitch hole. The lower thread is composed of discrete cut-off segments of a hook material, having hooks therein, wherein the lower thread interlocks with the upper thread, and extends transversely through the loop and is entrapped between the loop and the back side surface of the workpiece.

Alternatively, the lower thread can take the form of a hook material composed of discrete cut-off segments that are each aligned with a respective stitch hole. The upper thread extends down through the workpiece and the hook material. The upper thread forms a loop underneath the workpiece and the loop is interlocked with the hooks. Optionally, the workpiece can include the back side surface that is composed of a loop material having loops therein for interlocking with the hooks of the lower thread. Further still, the stitched article can also include an underlining applied to the back side of the workpiece and over the lower thread. The underlining can be composed of a loop material having loops therein interlocking with the hooks of the hook material of the lower thread to retain the underlining to the workpiece.

An apparatus is provided for producing the lock stitch of the present invention wherein the apparatus includes a needle, with an eyelet therethrough, for penetrating the workpiece to a back side thereof. A loop spreader mechanism is provided on the back side of the workpiece for spreading a loop of the upper thread, as is well known in the art. A feeder mechanism and conduit is provided for feeding a portion of the lower thread through the loop of the upper thread, wherein a portion of the lower thread is entrapped between the loop and the back side of the workpiece to complete the lock stitch.

An assembly method is provided for using the apparatus of the present invention to make the stitched article of the present invention. The method includes penetrating a workpiece with a needle that carries an upper thread therethrough, wherein a loop of the upper thread is formed on a back side of the workpiece. Next, the loop of the upper thread is enlarged by a loop spreader and a portion of a lower thread is fed through the loop of the upper thread. The lower thread is fed in a direction transverse to the travel of the upper thread, and the lower thread is composed of a hook material having hooks therein. Finally, the needle is retracted back through the workpiece and thus the upper thread is pulled back through the workpiece, the loop is pulled tightly against the lower thread and the lower thread is in turn pulled against a back side surface of the workpiece. During the retracting step, the upper thread interlocks with the hooks of the lower thread to securely lock the stitch in place.

Accordingly, it is an object of the present invention to reduce overall process time by eliminating the need to use a bobbin of limited lower thread supply. The present invention provides an unlimited length of lower thread such that interrupting the sewing cycle to resupply the bobbin is unnecessary. Stitch cycle time is also reduced, since the upper thread need not make the long travel around the bobbin.

It is another object to provide improved locking action between an upper and lower thread of a lock stitch via interlocking action between hook and loop material used for the lower thread and back side of the workpiece.

It is yet another object to provide a simplified machine and method for producing a lock stitch.

It is a further object of the present invention to reduce or eliminate the instances of thread breakage, as is prevalent in the prior art.

These objects and other features, aspects, and advantages of this invention will be more apparent after a reading of the following detailed description, taken in conjunction with the appended claims and accompanying drawings.

DETAILED DESCRIPTION OF THE PREFERRED EMBODIMENT

FIGS. 3 through 7 illustrate partially cutaway sectional views in order to more clearly show the stitching operation. Additionally, the term back side may mean, in general, the area underneath the workpiece as the workpiece is being sewn. Back side may also refer specifically to the actual surface on the back side of the workpiece. This characterization applies analogously to the term front side.

Figure 1:
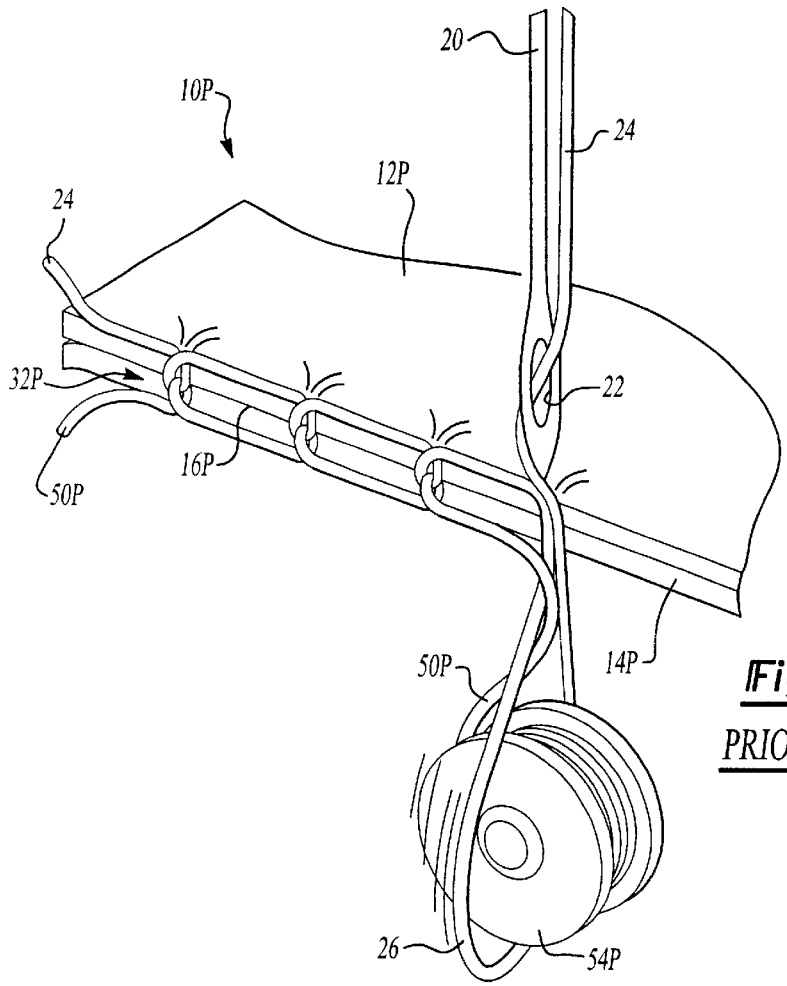
Fig-1 PRIOR ART
FIG. 1 is a perspective view of a seam being sewn according to a two-thread lock stitch of the prior art, wherein a lower thread wound on a bobbin is being passed through a loop in an upper thread to produce the lock stitch.
Figure 2:
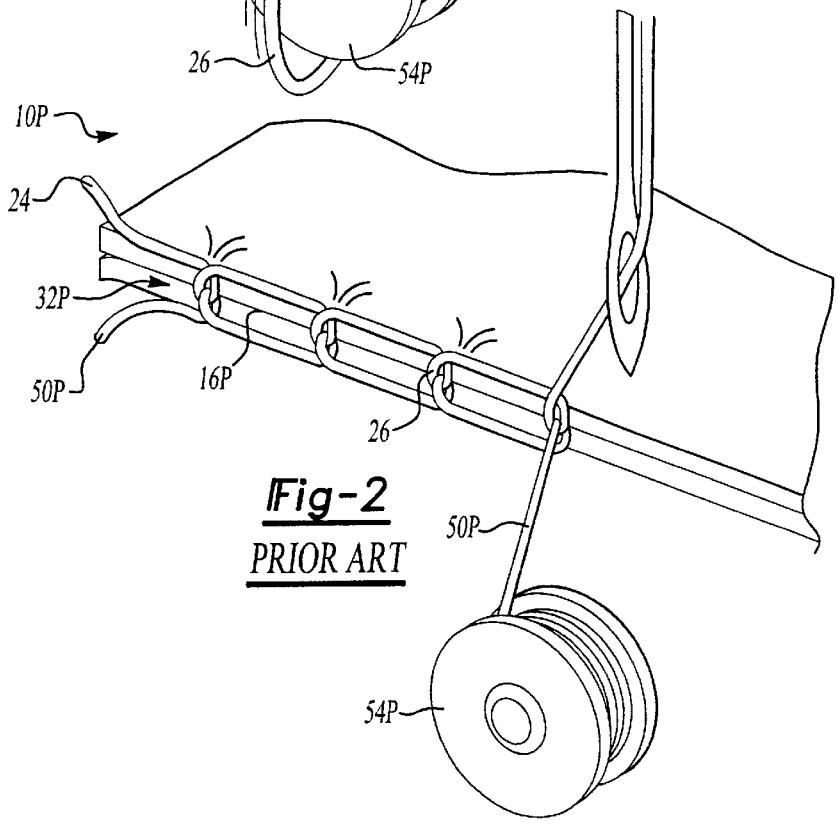
Fig-2 PRIOR ART
FIG. 2 is a perspective view of the seam of FIG. 1, wherein the upper thread is being pulled upwards to tighten against the lower thread to complete the lock stitch.
Figure 3:
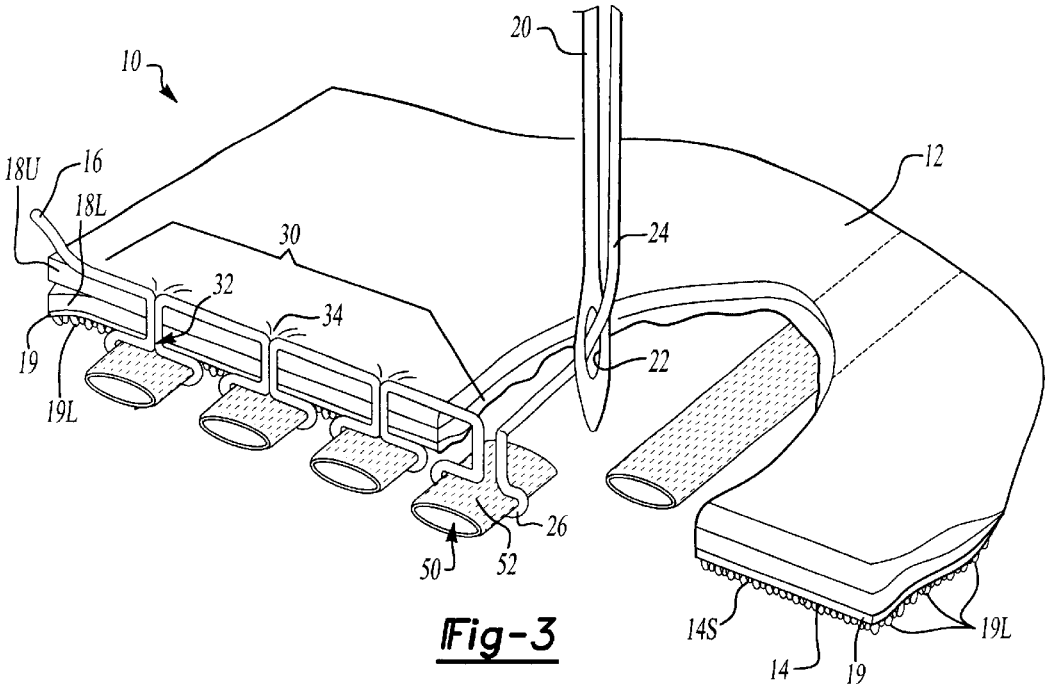
FIG. 3 is a partially cutaway perspective view of a seam being sewn into a workpiece according to one embodiment of the present invention.

Referring now in detail to the Figures and specifically to FIG. 3, there is shown an article or workpiece 10 undergoing a process of stitching according to an embodiment of the present invention. The workpiece 10 is shown as a combination of upper and lower plies 18U and 18L of material that are penetrable by a needle 20 from a top or front side 12 of the workpiece 10. On a bottom or back side 14 of the workpiece 10, a loop sheet 19 is preferably included in the form of an additional layer, but may instead take the form of individual patches or strips. As such, the loop sheet 19 establishes a back side surface 14S of the workpiece 10. The loop sheet 19 is consistent with hook and loop fastener material otherwise known under the trademark of VEL- CRO®. Thus, the loop sheet 19 includes a pattern of loops 19L therein. Alternatively, the loop sheet 19 may be formed of loop material composed of DACRON® polyester scrim or mesh, or have an integral loop laminate. For example, automobile interior material, such as simulated leather, typically includes a woven backing layer that could be replaced by a woven or non-woven material having loop characteristics.

An upper thread 24 is shown along a seam 30 having four lock stitches 32 completed within four stitch holes 34 in the workpiece 10. The upper thread 24 is preferably composed of any standard strand-like thread, but may also be composed of any other material including, for example, a monofilament line for limited applications, or a loosely stranded wire. The upper thread 24 includes a loop 26 that is formed underneath the workpiece 10 after the needle 20 penetrates the upper and lower plies 18U and 18L, and the loop sheet 19. A lower thread 50 is caused to move inside the loop 26 such that when the needle 20 is withdrawn from the workpiece 10 the lower thread 50 resides between the loop 26 of the upper thread 24 and the back side 14 of the workpiece 10, as the upper thread 24 is pulled upwards to tighten the loop 26, thus establishing the lock stitch 32. The lower thread 50 is preferably composed of material consistent with hook and loop fastener material, and, thus, includes a pattern of hooks 52 therein.

Figure 3A:
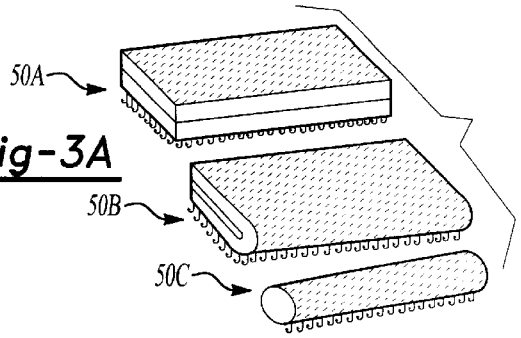
FIG. 3A is a perspective view of three examples of a lower thread composed of hook material.

Moreover, upon retraction of the needle 20 from the workpiece 10, the loop 26 of the upper thread 24 does not only encircle the lower thread 50, but forces engagement of the hooks 52 to the loops 19L on the loop sheet 19 to further secure the lock stitch. The hooks 52 of the lower thread 50 interlock with the loops of the loop sheet 19 underneath the workpiece 10 to secure the lock stitch. Those skilled in the art will recognize that the lower thread 50 preferably includes a cross-sectional area greater than the cross-sectional area of the stitch hole 34, thereby preventing the lower thread 50 from being pulled through the stitch hole 34 by the upper thread 24. The lower thread 50 is preferably formed as shown in FIG. 3 of discrete cut-off segments, cut from a continuous strip fed along the back side 14 of the workpiece 10. As shown in FIG. 3A, the lower thread 50 preferably takes the form of a cylindrical shape 50C. Alternatively, a laminate 50A, or a folded laminate 50B, could be used.

Figure 3B:
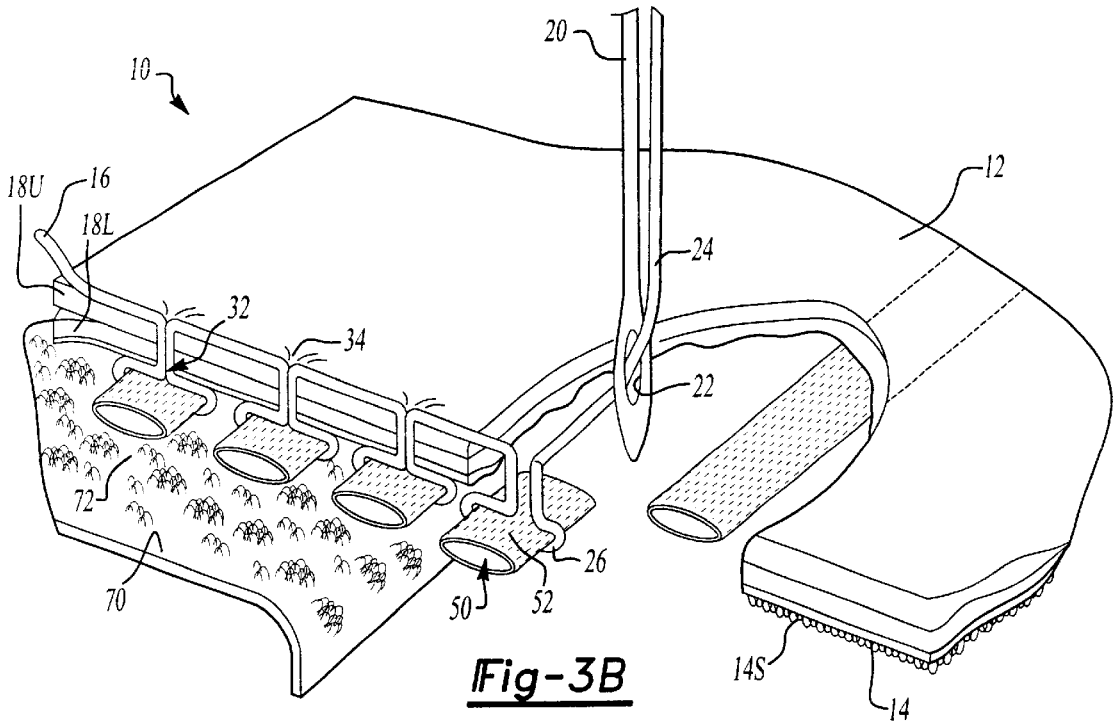
FIG. 3B is the workpiece of FIG. 3, further illustrating an underlining being applied underneath.

FIG. 3B illustrates an alternative application of the present invention with an underlining 70. The underlining 70 is shown as being secured to a side of the lower thread 50 that is opposite the side that interlocks with the loop sheet 19. The underlining 70 is also composed of a loop type material having loops 72 therein for interlocking with the hooks 52 of the lower thread 50. Such an underlining 70 is preferably an individual sheet or patch of material, but may also take the form of a component attached to a larger assembly such as a seat (not shown). Accordingly, the hooks 52 of the lower thread 50 of the workpiece 10 can be quickly and easily interlocked to corresponding VELCRO® loops of a seat, a headliner, a dashboard, etc.

Figure 4:
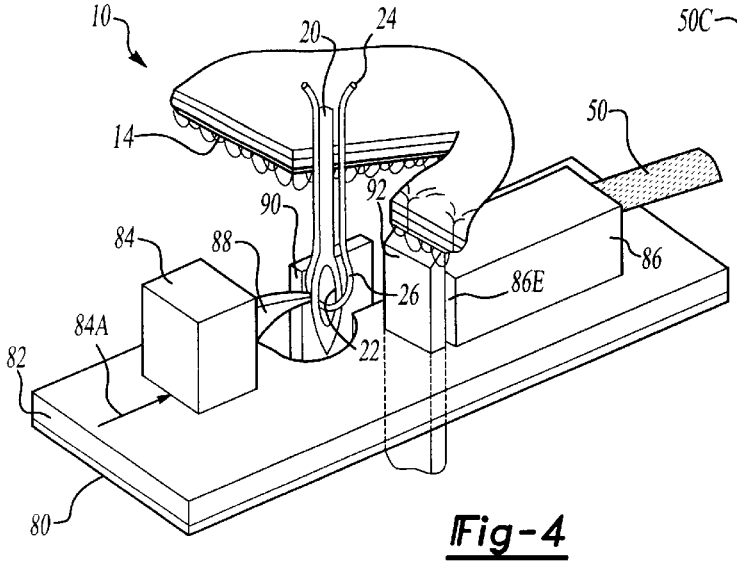
FIG. 4 is a partially cutaway perspective view of the stitching apparatus used for carrying out the method of the present invention.

FIG. 4 illustrates the portion of a sewing apparatus 80 that is preferably used to produce the stitched article of FIG. 3. Note that the direction of travel of the workpiece 10 in FIGS. 4 through 7 is exactly opposite that of FIG. 3, in order to more clearly show the loop 26 and lower thread 50 interaction. Located preferably underneath the workpiece 10, is a base 82 that supports an upright loop spreader 84 and conduit 86. The loop spreader 84 is moveably mounted with respect to the base 82 and includes a finger 88 as is consistent with such prior art devices. The conduit 86 is preferably fixed to the base 82, or alternatively can be moveable with respect to the base 82. A loop guard 90 extends parallel to but offset from the needle 20 and a blade 92 extends in the same direction as the needle 20 and abuts an exit end 86E of the conduit 86.

In operation, the needle 20 reciprocates down and up and carries in its eyelet 22 the upper thread 24 into and out of the workpiece 10 along the seam. As shown in FIG. 4, the needle 20 is carrying the upper thread 24 to the back side 14 of the workpiece 10 and has reached the bottom of its stroke. As the needle 20 begins its return, or upward stroke, the upper thread 24 becomes slack, thereby widening the loop 26, as is well known in the art. The loop guard 90 is aligned closely to one side of the needle 20 in order to push the slack in the upper thread 24 to the opposite side of the needle 20 for enlarging the loop 26, as is consistent with the prior art. Simultaneously, the loop spreader 84 begins to move toward the needle 20 as shown by arrow 84A from its home position as shown in FIG. 4.

The lower thread 50 is continuously fed through the conduit 86 in a direction transverse—preferably normal—to the direction of travel of the upper thread 24. The lower thread 50 can be fed in any convenient method, but is preferably fed in a similar manner to that which is well known in the prior art and best exemplified by U.S. Pat. No. 4,920,904 to Frye, which is incorporated by reference herein. The blade 92, in its up position as shown, temporarily blocks the lower thread 50 from advancing toward the loop 26.

Figure 5:
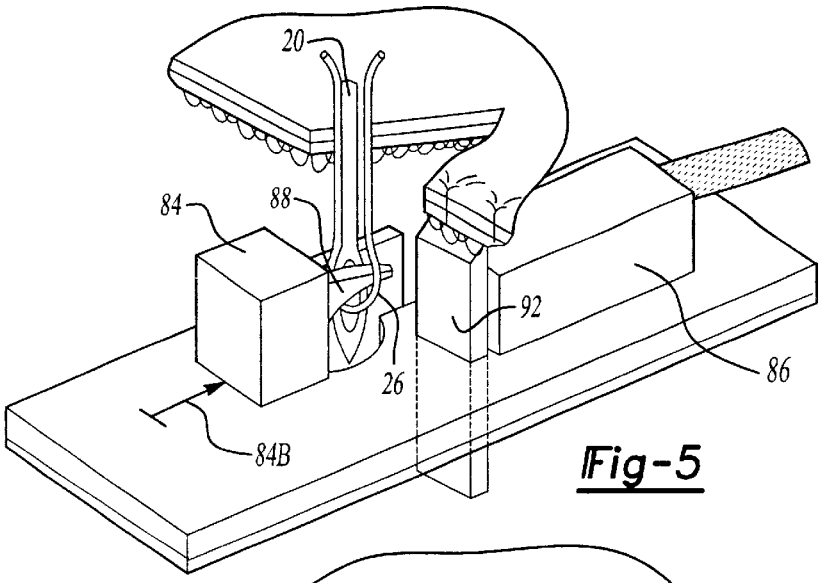
FIG. 5 is a partially cutaway perspective view of the stitching apparatus of FIG. 4 illustrating a loop spreading step.
Figure 6:
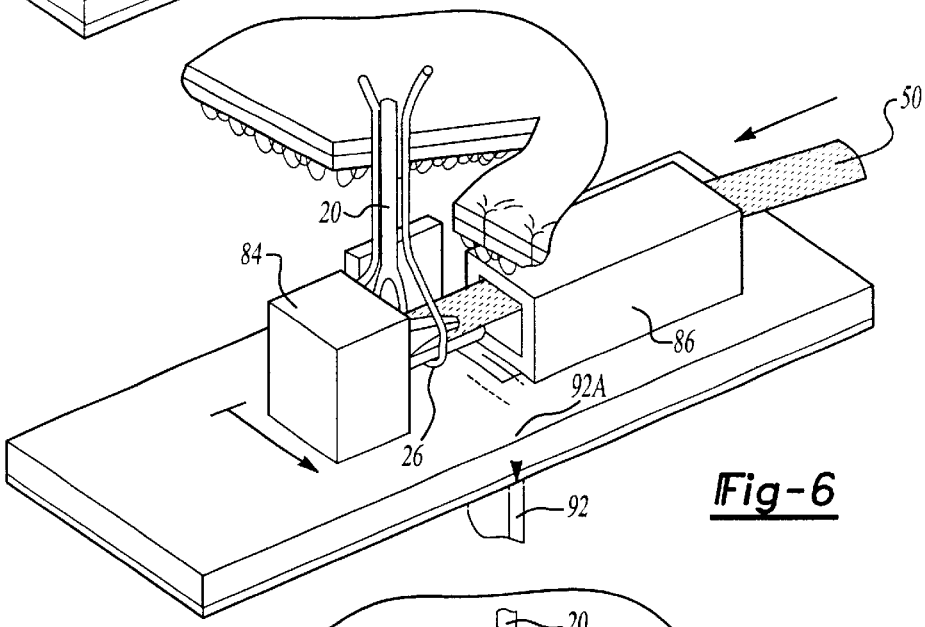
FIG. 6 is a partially cutaway perspective view of the stitching apparatus of FIG. 5, wherein a lower thread in the form of a strip is being fed through a loop in an upper thread.
Figure 7:
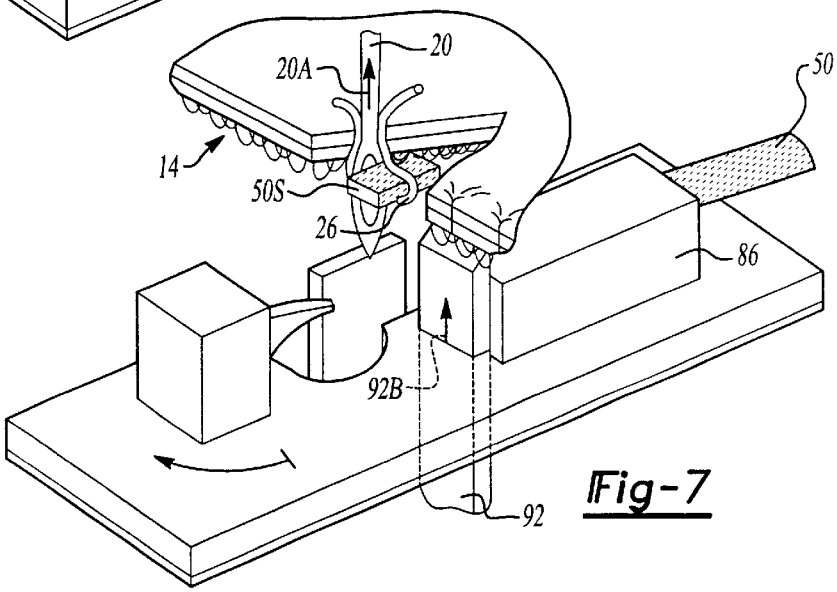
FIG. 7 is a partially cutaway perspective view of the stitching apparatus of FIG. 6, wherein the loop of the upper thread is being pulled against the lower thread to complete the lock stitch.

As shown in FIG. 5, the loop spreader 84 advances toward the needle 20 to its fully advanced position so that the finger 88 enters the loop 26. The blade 92 remains in its up position and the loop spreader 84 begins to move sideways as shown by arrow 84B. As shown in FIG. 6, the loop spreader 84 sweeps sideways to its fully open position away from the needle 20 in order to further enlarge the loop 26. Simultaneously, the blade 92 drops away from the conduit 86 as shown by arrow 92A to permit the lower thread 50 to feed forward through the enlarged loop 26 and stop against the loop spreader 84. Accordingly, a portion of the lower thread 50 is fed through the loop 26. As shown in FIG. 7, the blade 92 returns upward to its home position as shown by arrow 92B to sever the lower thread 50 into a discrete segment 50S of predetermined length. The needle 20 proceeds upward as shown by arrow 20A, thereby pulling and entrapping the discrete segment 50S of lower thread 50 in the loop 26 and forcing it against the back side 14 of the workpiece 10. Alternatively, and not shown, the conduit 86 advances through the loop 26 with the lower thread 50 housed therein to an advanced position. The conduit 86 would then retract back out of the loop 26 while the lower thread 50 maintains the advanced position within the loop 26. In this way, the conduit 86 would further ensure a proper feed of the lower thread 50 through the loop 26.

Figure 8A:
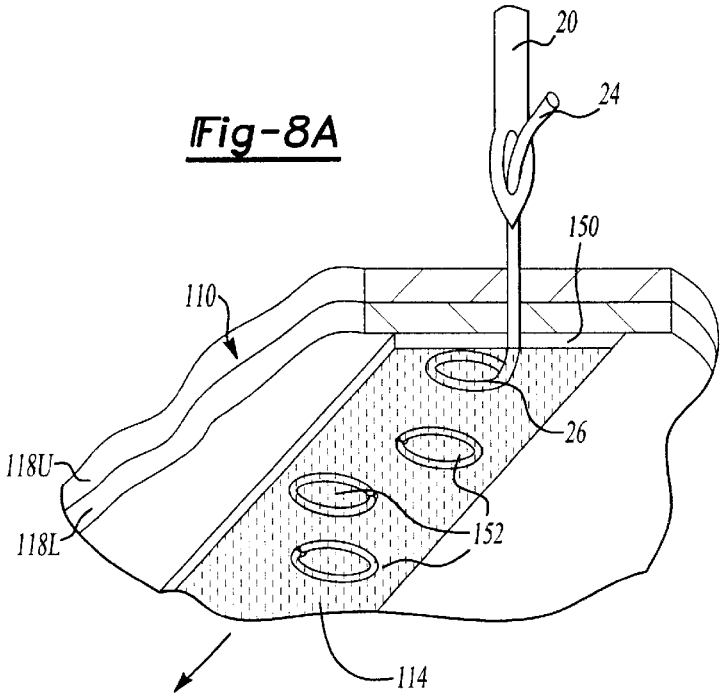
FIG. 8A is a partial bottom perspective view of a seam being sewn according to another embodiment of the present invention.
Figure 9:
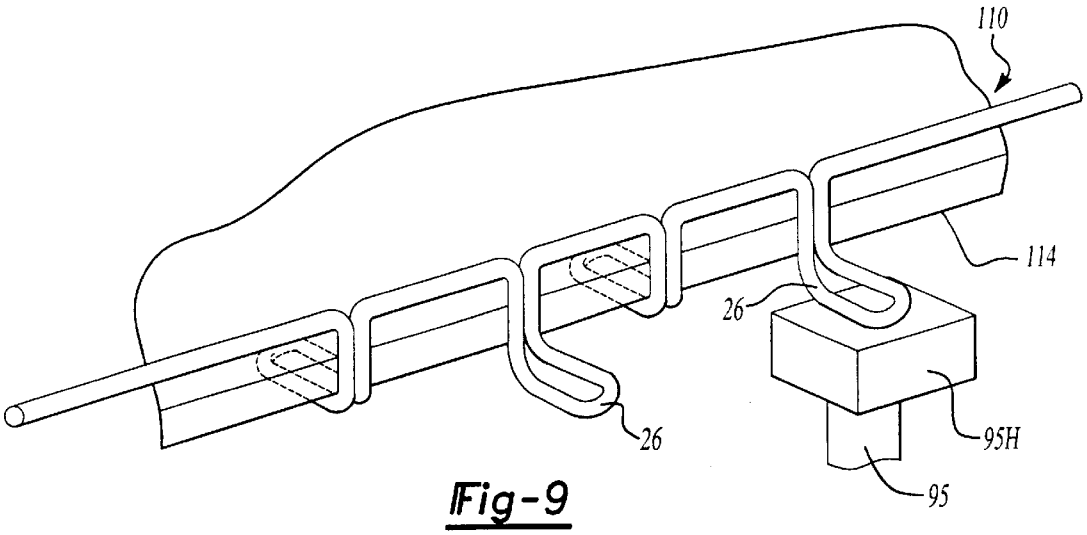
FIG. 9 is a partially cutaway perspective view of the seam of FIG. 8A, wherein a loop of an upper thread is being flattened against a bottom thread hook material.

As shown in FIGS. 8A and 9, an alternative article and method of sewing is presented. In FIG. 8A, a workpiece 110 includes upper and lower plies 118U and 118L, and a lower thread or hook material 150 establishing a back side surface 114 thereof. The hook material 150 preferably takes the form of a strip as shown, but can also take the form of patches or an entire sheet layer. The hook material 150 is preferably loosely applied to the back side of the workpiece 110, but may be permanently attached thereto. As shown in FIG. 8A, the needle 20 carries the upper thread 24 down and up through the workpiece 110. As discussed above, the loop 26 is formed along the back side surface 114 of the workpiece 110, as is well known in the art.

In contrast with the previous embodiment, however, only a hook portion 152 of the lower thread 150 is fed into engagement or interlocks with the loop 26. Here, the loop 26 is flattened against a portion of the hooks 152 of the hook material such that the loop 26 is spread out along the back side surface 114 amongst the hooks 152 for interlocking the upper thread 24 to the hooks 152 of the back side surface 114 of the workpiece 110. Accordingly, the loop 26 of the upper thread 24 is maintained and secured by the hooks 152 along the back side surface 114 of the workpiece 110 and will not pull through the stitch hole (not shown).

Figure 8B:
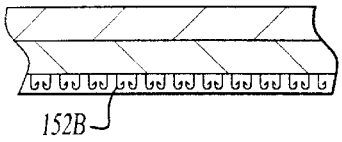
FIG. 8B is a partial sectional view of an alternative workpiece and hook material of FIG. 8A.
Figure 8C:
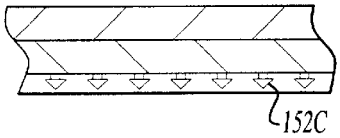
FIG. 8C is a partial sectional view of another alternative workpiece and hook material of FIG. 8A.
Figure 8D:
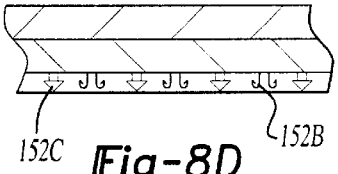
FIG. 8D is a partial sectional view of yet another alternative workpiece and hook material of FIG. 8A.

FIGS. 8B and 8C respectively show standard hooks 152B for use with a stranded upper thread 24, and shanked cones 152C for use with a monofilament thread (not shown). FIG. 8D illustrates a dual locking combination of standard hooks 152B and shanked cones 152C that are particularly suited for use with stranded types of thread. With this dual locking arrangement, the shanked cones 152C provide a positive transverse lock and maintain position of the upper thread 24 until the loop 26 is forced into engagement with the hooks 152B along the back side surface 114 of the workpiece 110. Additionally, the stranded upper thread 24 may be slightly unraveled so as to be more receptive to being interlocked with the standard hooks 152B and shanked cones 152C of the lower thread. Accordingly, the standard hooks 152B and shanked cones 152C are sufficiently rigid and sharp in order to interlock with strands of the stranded upper thread 24.

FIG. 9 illustrates one approach for flattening the standard loop 26 of the workpiece 110 of FIGS. 8A through 8C. FIG. 9 illustrates the workpiece 110 as a partial cutaway to better show the loop 26. A hammer tool 95 is advanced upward into engagement with the loop 26 and perpendicular to the back side surface 114 of the workpiece 110, so that the loop 26 flattens against the back side surface 114 of the workpiece 110. The loop 26 thus engages the hooks (not shown) of the back side surface 114 to retain the loop 26 from pulling back through the workpiece 110. A back side surface 114 combination of hooks 152B and shanked cones 152C, as shown in FIG. 8D, effects a situation where the upper thread (not shown) cleats around the shanked cones 152C thereby being securely positioned and then locked in that position by the hooks 152B. The hammer tool 95 is preferably advanced by a pneumatic cylinder located below the loop guard 90 and loop spreader apparatus (shown in FIG. 4). The hammer tool 95 also preferably includes a head 95H composed of a resilient and conformable material such as rubber. Additionally, the head 95H may have a predetermined surface configuration, such as one with projections, in order to more effectively force the loop 26 into interlocking engagement with the hooks.

Figure 10:
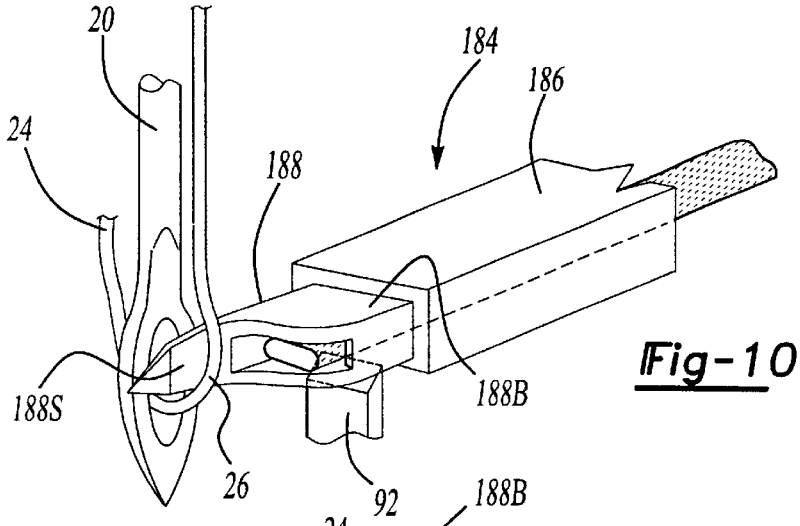
FIG. 10 is a perspective view of an alternative lower thread conduit and loop spreader device initially engaging the upper thread.

FIGS. 10 through 13 illustrate a portion of the preferred embodiment of the apparatus of the present invention. As shown in FIG. 10, a quill 184 replaces the stationary conduit 86 of FIGS. 4 through 7. The quill 184 includes a hollow housing 186 and a hollow spreader 188 that is slidingly disposed within the hollow housing 186. A spear portion 188S pointedly terminates a hollow body portion 188B of the spreader 188.

Figure 12:
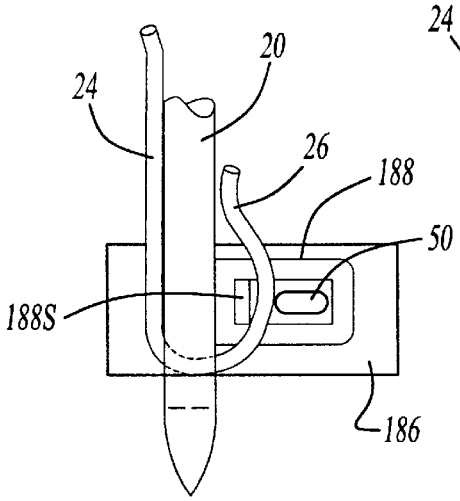
FIG. 12 is an end view of the device of FIG. 10 showing the loop of the upper thread initially engaged.

As shown in FIGS. 10 and 12, the spreader 188 and lower thread 50 advance from a home position within the housing 186 toward the needle 20. In this way, the spear portion 188S begins to run through the loop 26 of the upper thread 24 in an initial engagement position as shown. Beyond this initial engagement position, the spreader 188 and lower thread 50 continue to advance through the loop 26 until they reach an advanced position.

Figure 11:
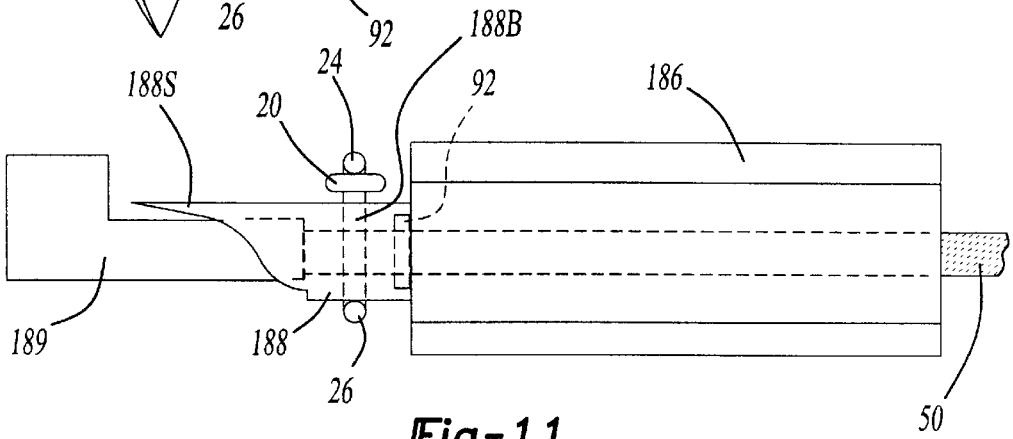
FIG. 11 is a top view of the device of FIG. 10 illustrating a quill fully inserted into the loop of the upper thread.
Figure 13:
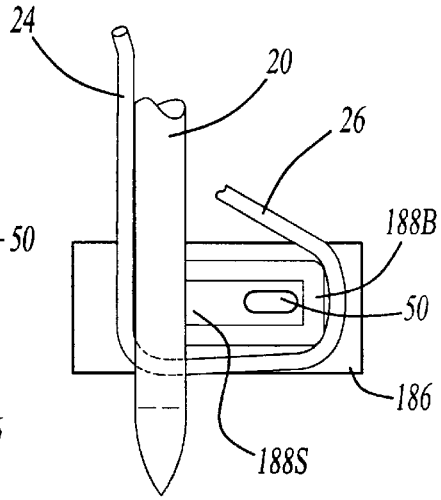
FIG. 13 is an end view of the device of FIG. 11 showing the loop of the upper thread fully enlarged.

The advanced position is set by a stopper 189, that locates on the end of the lower thread 50 to prevent it from advancing any further, as shown in FIG. 11. As best shown in FIGS. 11 and 13, as the spreader has advanced transversely through the loop 26, the loop 26 has gradually enlarged as it transitions from, or ramps over, the spear portion 188S to the body portion 188B of the spreader 188. Accordingly, the loop 26 directly circumscribes the body portion 188B that, in turn, circumscribes the lower thread 50. As a result, the lower thread 50 is now circumscribed by the loop 26 in the advanced position.

From this advanced position, the spreader 188 fully retracts back into the housing 186 to the home position, while the lower thread 50 remains in the advanced position circumscribed by the loop 26. Finally, at or near the same time the needle 20 and upper thread 24 are retracted back upward, the blade 92 advances upward to sever the lower thread 50 and complete the stitch cycle.

From the above, it can be appreciated that a significant advantage of the present invention is that the sewing process need not be interrupted to supply more lower thread to a bobbin, either due to thread breakage or limited thread supply. In fact, the present invention provides for continuity of lower thread supply, where the sewing cycle need not be interrupted to add additional lower thread.

An additional advantage is that the thread locking action is improved because the pull-up force of the upper thread causes the hooks of the lower thread to penetrate, entwine, encircle, interlock, and otherwise mesh with the upper thread strands and the back side loop material. Accordingly, the stitched seam will have a higher than traditional shear strength and will be more resistant to being ripped apart.

Another advantage is that the size of the upper thread can be varied without affecting the conformance of the stitch. Stitch conformance is therefore guaranteed since regardless of the upper thread pull-up force, the lower thread cannot be pulled up through the workpiece. Therefore, any tension adjustment of the upper thread is much less sensitive and easier to control than with current lock stitches.

Yet another advantage is that thread damage will not migrate beyond the stitch that is damaged. Each discrete segment of lower thread locked with the upper thread against the hooks on the back side surface ensures that damage to the continuous upper thread will not migrate beyond the adjacent damaged stitch. This is because of the inherently high shear and locking strength associated with hook and loop joining. Similarly, threading can be terminated without the need for multiple end stitches to prevent unraveling of the seam.

Still another advantage is that the stitches will be more moisture resistant since each discrete segment of lower thread effectively blocks off the stitch hole on one side. Hooks on the lower thread interlocking with loops on the back side surface of the workpiece even further ensure moisture resistance.

A further advantage is that the hooks of the lower thread provide an attachment base for any underlining material having loops therein, such that the workpiece has inherent fastening capability. Accordingly the workpiece can be removably secured to another object having such an underlining material. Alternatively, an independent underlining material can be removably secured to the lower threads of the workpiece until it can be permanently secured thereto, similar to a basting thread attachment.

Still a further advantage is that the stitch of the present invention is not as susceptible to thread wear as stitches of the prior art. Interlocked stranded threads of the prior art tend to failure prematurely due to rubbing action between relatively small surface areas on the threads. This is particularly true for stitches in seat cushions that typically bear heavy dynamic loads. With the present invention, the surface area between the threads is much larger since the lower thread is much larger than lower thread of the prior art. Accordingly, the stitch is more capable of distributing load per unit area between the threads, and therefore more robust against failure due to thread wear.

Yet a further advantage is that the length of the lower thread segments can be varied in order to increase strength and rigidity of the workpiece.

While the present invention has been described in terms of a preferred embodiment, it is apparent that other forms could be adopted by one skilled in the art. For example the location of the hooks and loops could be reversed, such that the lower thread has loops and the back side of the workpiece has hooks. Accordingly, the scope of the present invention is to be limited only by the following claims.

What is claimed is:

1. An assembly method for a stitched article having a seam, said assembly method comprising the steps of:

penetrating a workpiece with a needle carrying an upper thread therethrough, said upper thread forming a loop on a back side of said workpiece following said penetration by said needle;

enlarging said loop of said upper thread;

feeding a portion of a lower thread through said loop of said upper thread, said lower thread being fed from a direction transverse to said seam; and retracting said needle and said upper thread back through said workpiece, wherein said loop is pulled against said lower thread that in turn is pulled against a back side surface of said workpiece.

2. The method as claimed in claim 1, wherein said feeding step comprises said lower thread comprising a strip of material of predetermined thickness, said predetermined thickness preventing said lower thread from being pulled back through said workpiece by said loop upon said retracting step.

3. The method as claimed in claim 2, wherein said feeding step further comprises said lower thread comprising a hook material having hooks therein, said upper thread interlocking with said hooks during said retracting step to further secure said upper thread to said lower thread.

4. The method as claimed in claim 2, wherein said feeding step further comprises the steps of:

feeding said lower thread through a conduit;

advancing said conduit containing said lower thread through said loop of said upper thread to an advanced position; and retracting said conduit out of said loop while maintaining said advanced position of said lower thread to maintain said lower thread in said advanced position within said loop.

5. The method as claimed in claim 2, further comprising the step of severing said lower thread to form a discrete segment of said lower thread, said discrete segment being disposed within said loop of said upper thread.

6. The method as claimed in claim 3, wherein said workpiece further comprises a lower ply composed of loop material including loops therein, said hooks of said lower thread being pulled into interlocking engagement with said loops of said loop material.

7. The method as claimed in claim 3, further comprising the step of applying an underlining to said back side surface of said workpiece over said lower thread, said underlining being composed of a loop material including loops therein and interlocking with said hooks of said hook material of said lower thread to retain said underlining to said workpiece.

8. A stitch produced by the method as claimed in claim 1.

9. A method of sewing, said method comprising the steps of:

penetrating a workpiece with a needle including an eyelet for carrying an upper thread therethrough, said workpiece including a back side surface and a hook material disposed along said back side surface, said hook material comprising hooks therein;

enlarging a loop of said upper thread on a back side of said workpiece;

flattening said loop against said hook material of said workpiece such that said loop spreads out amongst said hooks to interlock therewith; and retracting said needle and said upper thread back through said workpiece, such that said loop is pulled against said hook material and retained thereagainst by said hooks.

10. The method as claimed in claim 9, wherein said penetrating step further comprises the step of feeding said hook material to said back side in discrete cut-off segments.

11. A stitched article produced using a needle, said stitched article comprising:

a workpiece including at least one stitch hole produced by said needle, said workpiece further including a back side surface comprising a hook material comprising hooks therein; and an upper thread extending downwardly through said at least one stitch hole and forming a loop underneath said workpiece, said loop being spread out amongst said hooks and interlocking therewith, said upper thread extending back up through said at least one stitch hole.

12. The stitched article as claimed in claim 11, wherein said hook material comprises discrete cut-off segments thereof aligned with each of said at least one stitch hole.

13. A stitched article produced using a needle to form a seam, said stitched article comprising:

a workpiece including at least one stitch hole therethrough produced by said needle, said workpiece further including a back side surface; and at least one stitch through said at least one stitch hole, said at least one stitch comprising:

an upper thread extending downwardly through said at least one stitch hole and forming a loop underneath said workpiece, said at least one stitch extending back upwardly through said at least one stitch hole; and a lower thread extending transversely through said loop and being entrapped between said loop and said back side surface of said workpiece, said lower thread extending transversely with respect to said seam.

14. The stitched article as claimed in claim 13, wherein said lower thread comprises a discrete segment of material of predetermined thickness, said predetermined thickness preventing said lower thread from being pulled back through said workpiece by said loop.

15. The stitched article as claimed in claim 14, wherein said discrete segment extends transversely through said loop of said upper thread, such that each of said at least one stitch includes said discrete segment of said lower thread extending through said loop, said lower thread comprising a hook material having hooks and shanked cones.

16. The stitched article as claimed in claim 13, wherein said lower thread comprises a hook material including hooks therein, said loop of said upper thread interlocking with said hooks.

17. The stitched article as claimed in claim 16, wherein said back side surface comprises loop material having loops therein, wherein said hooks of said hook material of said lower thread interlock with said loops of said loop material.

18. The stitched article as claimed in claim 15, further comprising:

an underlining applied at said back side surface of said workpiece over said lower thread, said underlining comprising a loop material including loops therein, said loops interlocking with said hooks of said hook material of said lower thread to retain said underlining to said workpiece.

19. An apparatus for producing a lock stitch in a workpiece, said apparatus comprising:

a needle having an eyelet therethrough, said needle penetrating said workpiece through to a back side thereof, said eyelet carrying an upper thread that comprises a strand-like material and a loop;

means for enlarging said loop of said upper thread at said back side of said workpiece; and means for feeding a portion of a lower thread through said loop of said upper thread, said lower thread comprising a hook material including hooks therein;

whereby at least a portion of said lower thread is entrapped between said loop of said upper thread and said workpiece to complete said lock stitch.

20. The apparatus as claimed in claim 19, wherein said means for enlarging comprises a loop spreader having a finger thereon, said loop spreader advancing from a home position toward said loop to an advanced position for penetrating said loop, said loop spreader then traversing sideways to draw open said loop, said loop spreader then sweeping back to said home position.

21. The apparatus as claimed in claim 19, wherein said means for feeding comprises a quill through which said lower thread is fed, said quill comprising a hollow housing and a hollow loop spreader disposed within said hollow housing, said hollow loop spreader having a body portion and a spear portion pointedly terminating said body portion for piloting through said loop of said upper thread, whereby said hollow loop spreader and said lower thread advance from a home position to an advanced position through said loop, said hollow loop spreader being retracted back to said home position with said lower thread remaining in said advanced position within said loop.

22. The apparatus as claimed in claim 21, further comprising:

means for severing said lower thread into a discrete segment of predetermined length, said discrete segment remaining disposed within said loop.

23. The apparatus as claimed in claim 22, wherein said means for severing comprises a blade mounted proximate one end of said quill, for shearing said lower thread.

24. The apparatus as claimed in claim 19 further comprising means for forcing and flattening said loop into interlocking engagement with said hooks of said hook material.

25. The apparatus as claimed in claim 24 wherein said means for flattening comprises a hammer device mounted below said workpiece.

26. A method of assembling an article, said method comprising the steps of:

penetrating a workpiece with an upper thread:

forming a loop with said upper thread on a back side of said workpiece;

feeding a lower thread segment of predetermined thickness through said loop; and retracting said upper thread back through said workpiece, wherein said loop is pulled against said lower thread segment that in turn is pulled against a back side surface of said workpiece, said predetermined thickness of said lower thread segment preventing said loop of said upper thread from being pulled back through said workpiece upon said retracting step.

27. The method as claimed in claim 26, wherein said lower thread segment comprises a hook and loop material having hooks and loops therein, said upper thread interlocking with said hook and loop material during said retracting step to further secure said upper thread to said lower thread segment.

28. The method as claimed in claim 27, wherein said workpiece further comprises a lower ply composed of loop material including loops therein, said hooks of said lower thread segment being pulled into interlocking engagement with said loops of said loop material.

29. The method as claimed in claim 28, further comprising the step of applying an underlining to said back side surface of said workpiece over said lower thread segment, said underlining being composed of a loop material including loops therein and interlocking with said hooks of said hook material of said lower thread segment to retain said underlining to said workpiece.

30. The method as claimed in claim 26, wherein said feeding step further comprises the steps of:

feeding said lower thread segment through a conduit;

advancing said conduit containing said lower thread segment through said loop of said upper thread to an advanced position; and retracting said conduit out of said loop while maintaining said advanced position of said lower thread segment to maintain said lower thread segment in said advanced position within said loop.

31. The method as claimed in claim 26, further comprising the step of severing said lower thread segment to form a discrete segment of said lower thread segment, said discrete segment being disposed within said loop of said upper thread.

32. A stitch produced by the method as claimed in claim 26.

33. An article comprising:

a workpiece including a back side surface; and at least one stitch through said workpiece, said at least one stitch comprising:

an upper thread extending downwardly through said workpiece and forming a loop underneath said workpiece, said upper thread extending back upwardly through said workpiece; and a lower thread segment of predetermined thickness extending through said loop and being entrapped between said loop and said back side surface of said workpiece, wherein said predetermined thickness prevents said loop of said upper thread from being pulled through said workpiece and thereby keeps said at least one stitch intact.

34. The stitched article as claimed in claim 33, wherein said lower thread segment extends transversely through said loop of said upper thread, such that said at least one stitch includes said lower thread segment extending through said loop, said lower thread segment comprising a hook and loop material having hooks and loops, said hooks and loops of adjacent segments of said lower thread segment interlocking.

35. The stitched article as claimed in claim 33, wherein said lower thread segment comprises a hook material including hooks therein, said loop of said upper thread interlocking with said hooks.

36. The stitched article as claimed in claim 35, wherein said back side surface comprises loop material having loops therein, wherein said hooks of said hook material of said lower thread segment interlock with said loops of said loop material.

37. The stitched article as claimed in claim 34, further comprising:

an underlining applied at said back side surface of said workpiece over said lower thread segment, said underlining comprising a loop material including loops therein, said loops interlocking with said hooks of said hook material of said lower thread segment to retain said underlining to said workpiece.

* * * * *